US008678848B2

(12) United States Patent
Chan

(10) Patent No.: US 8,678,848 B2
(45) Date of Patent: Mar. 25, 2014

(54) PLUGGABLE DATA COMMUNICATION MODULE WITH MOVING-PIN LATCH

(75) Inventor: Seng-Kum Chan, Santa Clara, CA (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 213 days.

(21) Appl. No.: 13/290,230

(22) Filed: Nov. 7, 2011

(65) Prior Publication Data

US 2013/0115800 A1 May 9, 2013

(51) Int. Cl.
*H01R 13/62* (2006.01)

(52) U.S. Cl.
USPC ..... 439/372; 439/159

(58) Field of Classification Search
USPC ..... 439/159, 160, 352, 353, 372, 483, 484
See application file for complete search history.

(56) References Cited

U.S. PATENT DOCUMENTS

| | | | |
|---|---|---|---|
| 6,884,097 | B2 | 4/2005 | Ice |
| 6,991,481 | B1 | 1/2006 | Guan et al. |
| 7,220,066 | B2 | 5/2007 | Kim et al. |
| 7,517,160 | B2 | 4/2009 | Miyoshi et al. |
| 7,883,274 | B2 | 2/2011 | Luo et al. |

*Primary Examiner* — Khiem Nguyen

(57) ABSTRACT

A latch mechanism of a data communication module operates by a portion of an actuator sliding in a slot in the module housing that is oriented at an oblique angle with respect to the longitudinal axis of the module housing, thereby translating a force generated in a direction parallel to the longitudinal axis of the module housing into a force in a direction perpendicular to the longitudinal axis as the bail of the latch mechanism pivots between a latched position and an unlatched position. A first end of the actuator is coupled to the bail through a cam pivot. A second end of the actuator has a pin portion that extends through or retracts into an opening in a wall of the module housing.

20 Claims, 9 Drawing Sheets

PLUGGABLE DATA COMMUNICATION MODULE WITH MOVING-PIN LATCH

BACKGROUND

In data communication systems, it is often useful to modularize interface electronics and other interface elements in a data communication module. For example, in an optical data communication system, an opto-electronic transceiver module may include a light source such as a laser, and a light receiver such as a photodiode, and may also include driver and receiver circuitry associated with the laser and photodiode. To use such an opto-electronic transceiver module, an optical fiber cable is plugged into a port in the module. Such a module also includes electrical contacts that can be coupled to an external electronic system.

Another example of a data communication module is an Ethernet transceiver module. To use an Ethernet transceiver module, an Ethernet cable, which may have an electrical rather than an optical connector, is plugged into a port in the module. The module may include signal conditioning electronics. Such a module also includes electrical contacts that can be coupled to an external electronic system.

Some data communication modules are configured to be plugged into a cage or other receptacle. A standard communication module configuration commonly referred to in the art as Small Form Factor Pluggable (SFP) includes an elongated housing having a generally rectangular profile. An SFP module is pluggable into a metallic cage that shields the module against electromagnetic interference (EMI). A latching mechanism retains the SFP module in the EMI cage. The latching mechanism typically includes a bail that can be pivoted or flipped between a latched position in which the bail lies against the forward end of the module and an unlatched position in which the bail extends outwardly away from the module.

The latching mechanism of an SFP module typically comprises a pin on the module housing and a catch on the cage. As the module is inserted into the cage, the pin engages an opening in the catch to latch the module in place in the cage. To release or unlatch the module from the cage, the bail is flipped or pivoted downwardly to the above-described unlatched position, which disengages the pin and the catch from each other by moving one of the pin or the catch relative to the other. The outwardly extending bail can then be used as a handle to withdraw the module from the cage. Prior latching mechanisms for SFP modules generally fall into two categories: moving catch and moving pin.

A moving-catch latching mechanism unlatches the pin from the catch by flexing the catch away from the pin in response to the downward motion of the bail so that the pin and catch do not interfere with each other when the module is withdrawn from the cage. Moving-catch latching mechanisms promote manufacturing efficiency by minimizing the number of parts. However, moving-catch latching mechanisms suffer from dependence upon the resilience or flexibility of the catch.

A moving-pin latching mechanism de-latches the pin from the catch by causing the pin to retract into the module housing in response to the pivoting motion of the bail so that the pin and catch do not interfere with each other when the module is withdrawn from the cage. Moving-pin latching mechanisms do not depend upon flexibility of the catch and provide low frictional resistance between the pin and catch. However, prior moving-pin latching mechanisms can be complex, involving a substantial number of moving parts, resulting in manufacturing inefficiency.

SUMMARY

Embodiments of the present invention relate to a data communication module that includes a module housing, a bail and an actuator. In an exemplary embodiment, a latch mechanism operates by a portion of the actuator sliding in a slot in the module housing that is oriented at an oblique angle with respect to the longitudinal axis of the module housing. The module housing can have a generally rectangular profile and be elongated in a direction of the longitudinal axis between its first and second ends. The first end of the module housing has a module port for receiving a signal cable plug connector. The second end of the module housing has electrical contacts. An electronic assembly in the housing provides a processing path for the data communication signals between the module port and the electrical contacts.

The bail is mounted to the first end of the module housing through a bail pivot and is pivotable between a first position, in which the module is latched, and a second position, in which the module is not latched (unlatched). The actuator has a first end, a second end, and a portion that engages the slot in the housing in a sliding manner. The first end of the actuator is coupled to the bail through a cam pivot. The second end of the actuator has a pin portion that can be retracted into an opening in a wall of the module housing when the module is unlatched. Thus, the actuator moves or extends the pin portion out of the opening in the wall in response to the bail pivoting to the first or latched position, and moves or retracts the pin portion into the opening in the wall in response to the bail pivoting to the second or unlatched position.

Other systems, methods, features, and advantages will be or become apparent to one with skill in the art upon examination of the following figures and detailed description. It is intended that all such additional systems, methods, features, and advantages be included within this description, be within the scope of the specification, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1A:
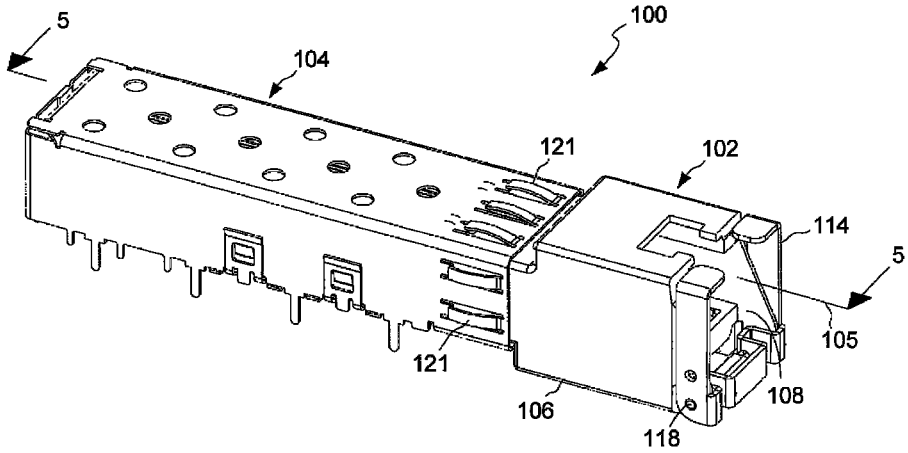
FIG. 1A is a top perspective view of a data communication module latched in an EMI cage, in accordance with an exemplary embodiment of the invention.
Figure 1B:
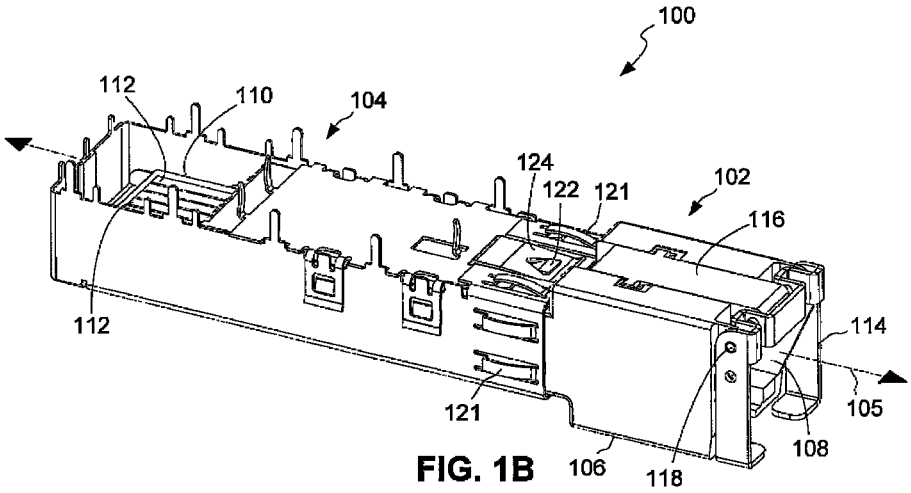
FIG. 1B is a bottom perspective view of the data communication module of FIG. 1A.

As illustrated in FIGS. 1A-B, in an illustrative or exemplary embodiment of the invention, a data communication module system 100 comprises a data communication module 102 and an electromagnetic interference (EMI) cage 104. In the manner described below, data communication module 102 can be secured or latched within EMI cage 104 and then released or unlatched so that it can be removed from EMI cage 104.

Data communication module 102 can include an elongated (along a longitudinal axis 105) module housing 106 having a rectangular cross-sectional shape. A first end of module housing 106 has a module port 108 for receiving a signal cable plug connector (not shown). As well understood in the art, such a signal cable plug connector commonly includes a cable that comprises a signal carrier, such as a copper wire or an optical fiber, and terminates in a plug. When such a connector is plugged into module port 108, data signals can be communicated between the cable and data communication module 102.

An electronic assembly, which can include a printed circuit board 110 (FIG. 1B) and electronic elements 111 (FIGS. 5-6) mounted on printed circuit board 110, provides a means for processing the data signals and thus provides a signal processing path between electrical contact pads 112 on printed circuit board 110 at the second end of module housing 106 and electrical contact fingers 113 (FIGS. 5-6) of module port 108. As well understood in the art, data communication module 102 is pluggable into a connector (not shown) that receives electrical contact pads 112 to communicate signals between data communication module 102 and an external system on which EMI cage 104 and such a connector are mounted. The above-described shape, port arrangement, operation and other characteristics define a standard type of data communication module commonly referred to as Small Form Factor Pluggable (SFP). Variations of the SFP module type are known, such as SFP+, but all such data communication modules having the above-described characteristics are of the family of module types generally referred to as SFP. Although in the exemplary embodiment described herein data communication module 102 is of an SFP type that processes electrical signals (e.g., Ethernet signals), in other embodiments data communication modules of the present invention can be of any other SFP type or similar type that processes optical signals or combinations of optical and electrical signals. As details of the electronic assembly that provides such processing are not relevant to the invention, the electronic assembly is not described in further detail.

Figure 2A:
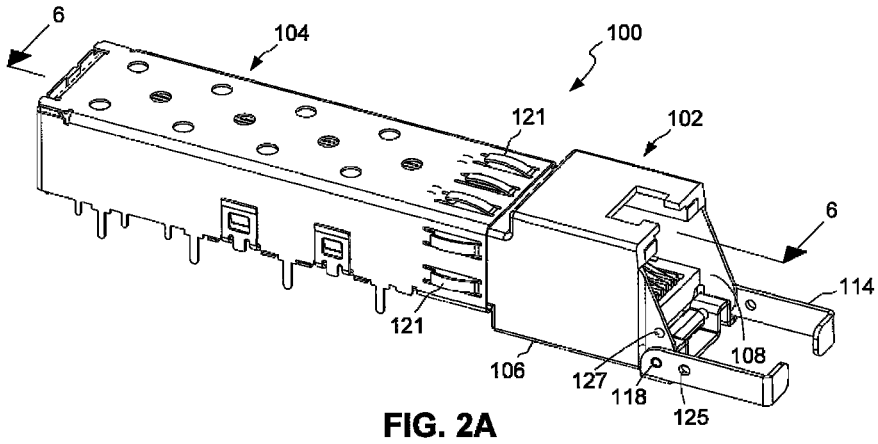
FIG. 2A is similar to FIG. 1A, showing the data communication module in an unlatched state in the EMI cage.
Figure 2B:
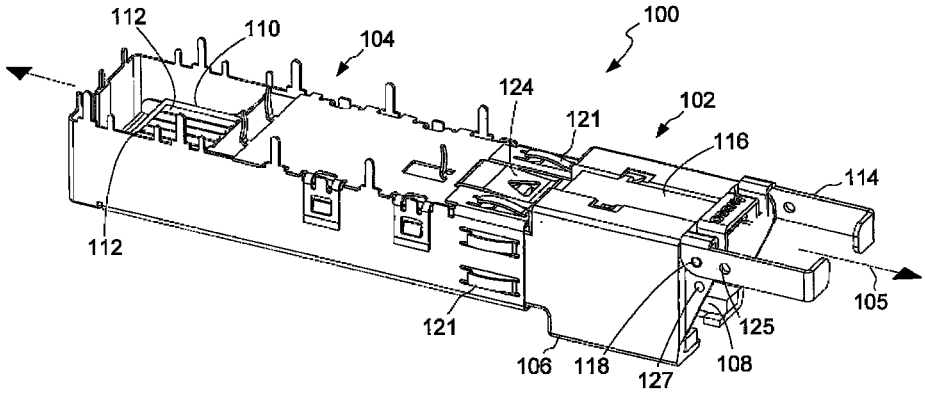
FIG. 2B is a bottom perspective view of the data communication module of FIG. 2A.
Figure 7A:
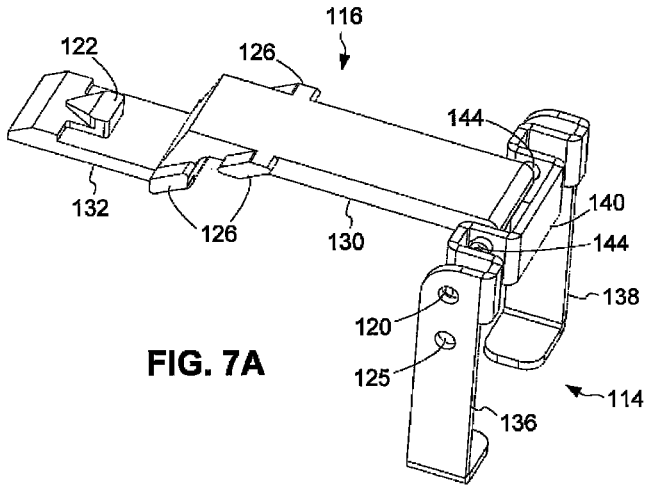
FIG. 7A is a perspective view of the bail and actuator of the data communication module of FIGS. 1-6, showing the bail in the latched position.
Figure 7B:
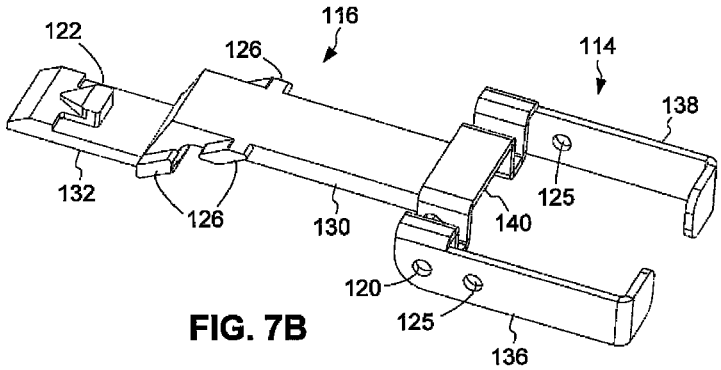
FIG. 7B is similar to FIG. 7A, showing the bail in the unlatched position.

Data communication module 102 further includes a bail 114 and an actuator 116. In FIGS. 1A-B, bail 114 is shown in a first position or latched position. In FIGS. 2A-B, bail 114 is shown in a second position or unlatched position. Bail 114 can be moved between the latched and unlatched positions by pivoting it about a bail pivot comprising the combination of a pair of pins 118 on opposing sides of the first end of module housing 106 and a corresponding pair of bail pivot holes 120 (FIGS. 7A-B) in bail 114 into which pins 118 extend.

EMI cage 104 can be made of sheet metal and can have an elongated rectangular shape, with an interior space or bay having a cross-sectional shape (profile) and a length generally corresponding to the profile and length of the portion of module housing 106 that is received within EMI cage 104. EMI cage 104 can include an EMI skirt 121 comprising a number of resilient fingers distributed about the opening that receives the rearward portion of data communication module 102. Module housing 106 can include similar resilient fingers 123 (FIGS. 3A and 4B) that aid mechanical and electrical contact between the exterior of module housing 106 and the interior of EMI cage 104.

Figure 3A:
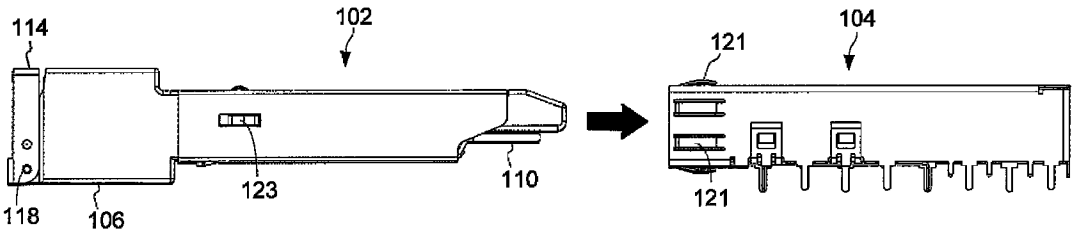
FIG. 3A is a side elevation view, showing the data communication module of FIGS. 1-2 as it is being inserted into the EMI cage.
Figure 3B:
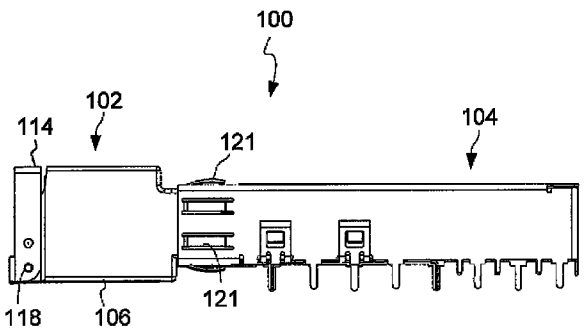
FIG. 3B is similar to FIG. 3A, showing the data communication module after being inserted into the EMI cage.

As illustrated in FIG. 3A, with bail 114 pivoted to the latched position, the rearward portion of data communication module 102 can be inserted into the opening in EMI cage 104. Data communication module 102 becomes latched in EMI cage 104 when a pin portion 122 of actuator 116 engages a catch 124 (FIG. 1B) on EMI cage 104. Catch 124 comprises an opening in a tab-like portion of EMI cage 104 that resiliently flexes in response to pin portion 122 moving into contact with catch 124 and displacing it slightly. That is, pin portion 122 flexes catch 124 outwardly until pin portion 122 is aligned with the opening, at which point catch 124 snaps over pin portion 122 and captures pin portion 122 within the opening. While data communication module 102 is latched in EMI cage 104 as shown in FIG. 3B, data communication module 102 resists being withdrawn from EMI cage 104 due to the captured pin portion 122.

Figure 4A:
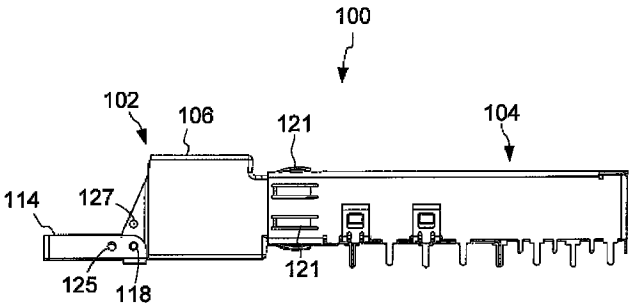
FIG. 4A is similar to FIG. 3B, showing the data communication module in an unlatched state in the EMI cage.
Figure 4B:
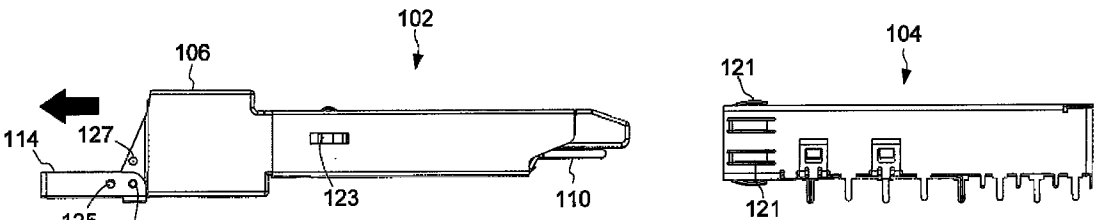
FIG. 4B is similar to FIG. 4A, showing the data communication module in an unlatched state as it is being removed from the EMI cage.

As illustrated in FIGS. 4A-B, bail 114 includes a pair of retainer holes 125 that can engage a corresponding pair of bumps 127 on module housing 106 to help hold bail 114 in the latched position. The latching mechanism and the manner in which it operates are described in further detail below.

With bail 114 pivoted to the unlatched position shown in FIG. 4A, the latch mechanism no longer causes data communication module 102 to resist being withdrawn from EMI cage 104. As described in further detail below, pivoting bail 114 to the unlatched position causes pin portion 122 of actuator 116 to retract into the wall of module housing 106 defined by catch 124, thereby releasing it from catch 124 (FIG. 2B). In the unlatched position, bail 114 can be gripped with one's fingers and used as a handle to facilitate withdrawing data communication module 102 from EMI cage 104, as shown in FIG. 4B.

Figure 8:
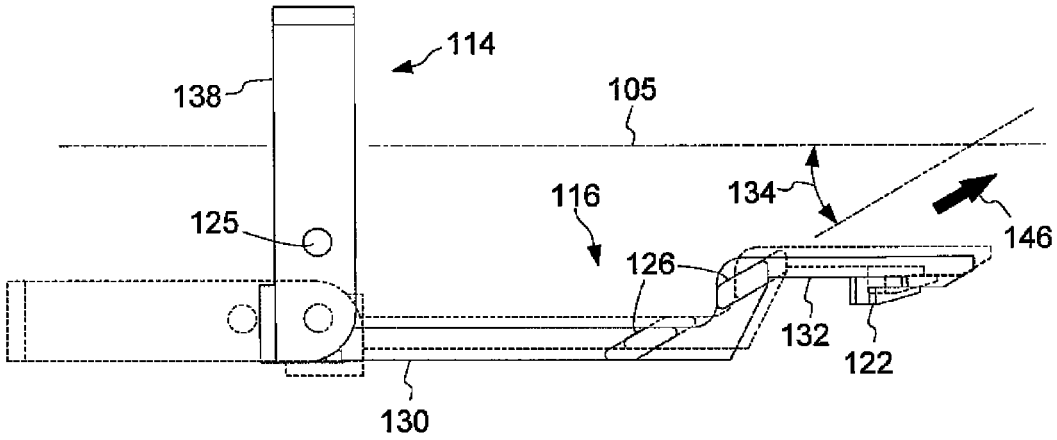
FIG. 8 is a side elevation view of the bail and actuator of the data communication module of FIGS. 1-6, showing the movement of the actuator in response to the bail pivoting between the latched and unlatched positions.

As illustrated in FIGS. 5-9, the latch mechanism that provides the means for latching data communication module 102 in EMI cage 104 is based upon a ramp portion 126 (FIGS. 7-8) of actuator 116 engaging a slot 128 (FIG. 9) in module housing 106 in a sliding manner. Actuator 116 further includes a first actuator portion 130 and a second actuator portion 132, with ramp portion 126 disposed between first and second actuator portions 130 and 132 (FIGS. 7-8).

Figure 9:
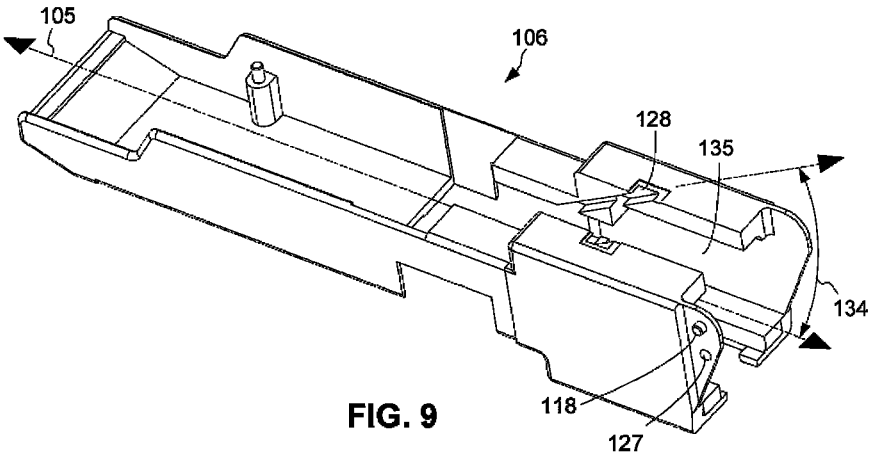
FIG. 9 is a perspective view of the module housing of the data communication module of FIGS. 1-6.

Slot 128 and ramp portion 126 are oriented at an oblique angle 134 with respect to longitudinal axis 105 (FIGS. 8-9). Note that first actuator portion 130 and a second actuator portion 132 have generally flat, tongue-like shapes that are oriented parallel to longitudinal axis 105 in module housing 106. Note that pin portion 122 extends away from a surface of second actuator portion 132 in a direction perpendicular to longitudinal axis 105.

Figure 10:
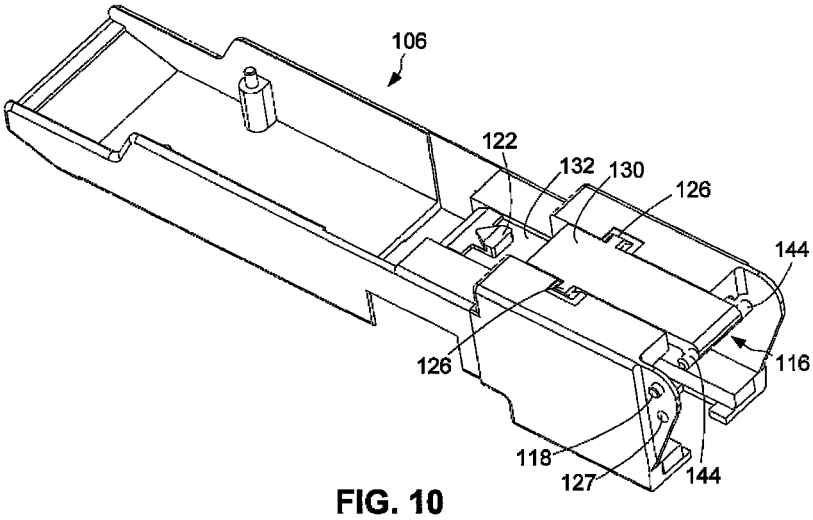
FIG. 10 is a perspective view of the module housing and actuator of the data communication module of FIGS. 1-6.

As illustrated in FIGS. 9-10, first actuator portion 130 is disposed in a region 135 in a bottom wall of module housing 106. Slot 128 is defined in part by a portion or groove in a sidewall of module housing 106 and in part by an opposing portion or groove in an opposing sidewall of module housing 106. Ramp portion 126 of actuator 116 extends between these two grooves or portions of slot 128 and thus engages slot 128.

Figure 11:
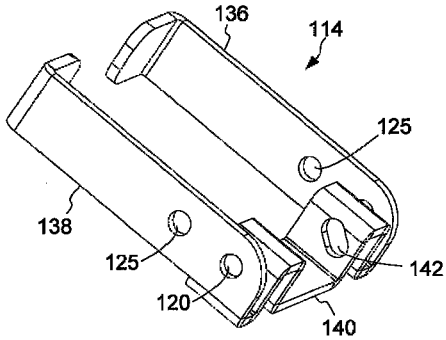
FIG. 11 is a perspective view of the bail of the data communication module of FIGS. 1-6.
Figure 12:
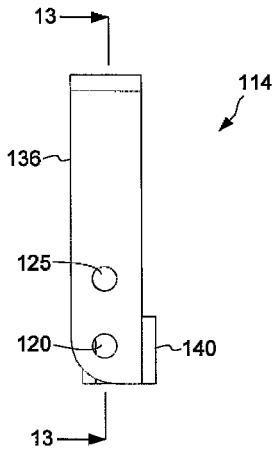
FIG. 12 is a side elevation view of the bail of FIG. 11.
Figure 13:
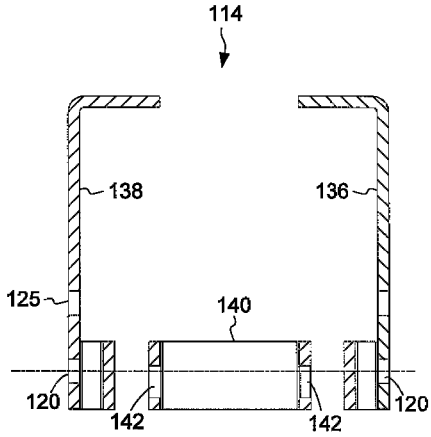
FIG. 13 is a sectional view taken on line 13-13 of FIG. 12.

As illustrated in FIGS. 11-13, bail 114 includes two arms 136 and 138 disposed parallel to each other, and a base portion 140 connecting arms 136 and 138. Arms 136 and 138 abut opposing sides of port 108 when bail 114 is in the latched position. Base portion 140 has a pair of elongated cam holes 142. It can be seen in FIG. 13 that cam holes 142 are disposed eccentrically with respect to bail pivot holes 120 to promote the cam-like operation. A cam pivot comprises a pair of cam pivot pins 144 (FIG. 10) at the first end of actuator 116 and a corresponding pair of cam holes 142 (FIGS. 11 and 13) in arms 136 and 138 into which cam pivot pins 144 extend.

Figure 5:
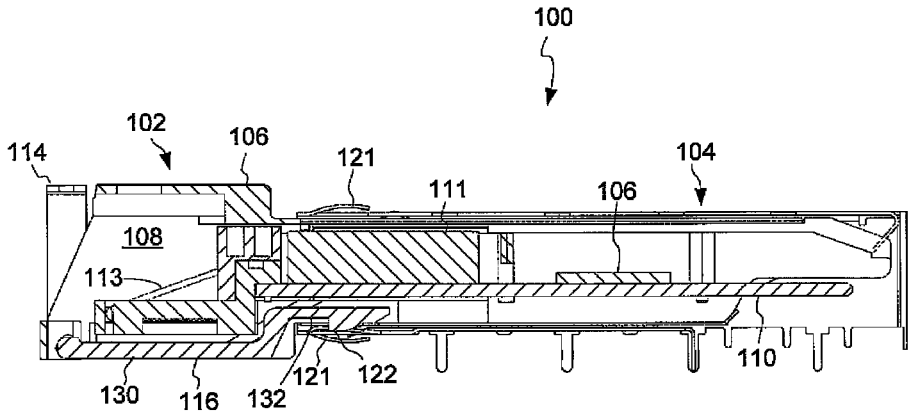
FIG. 5 is a sectional view taken on line 5-5 of FIG. 1A.

When bail 114 is in the latched position, the cam pivot places actuator 116 in the position shown in FIG. 5 and (in solid line) in FIG. 8. In this latched position, pin portion 122 extends into the opening of catch 124, as shown in FIG. 5.

Figure 6:
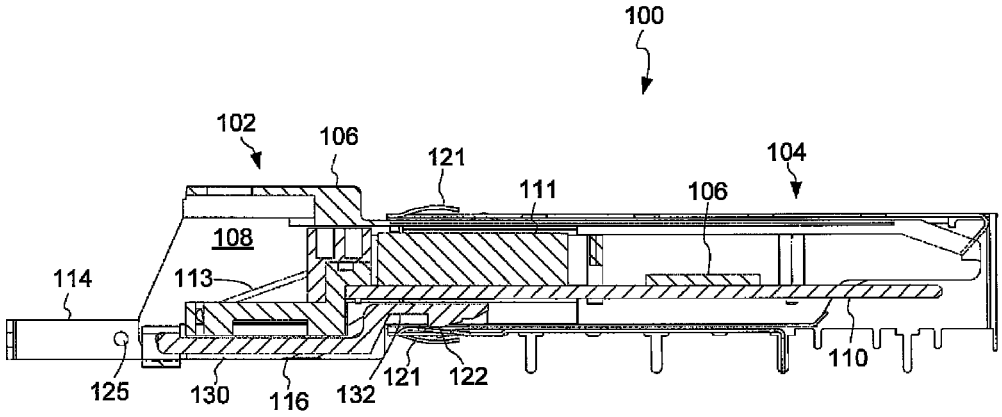
FIG. 6 is a sectional view taken on line 6-6 of FIG. 2A.

As bail 114 is pivoted downwardly toward the unlatched position, the cam pivot urges actuator 116 toward the position shown in FIG. 6 and (in broken line) in FIG. 8. Note that pin portion 122 moves in both a rearward direction, i.e., parallel to longitudinal axis 105, and an upward direction, as indicated by the arrow 146 in FIG. 8. The combination of rearward and upward movement indicated by arrow 146 lifts pin portion 122 out of the opening of catch 124 and retracts pin portion 122 further into the wall of module housing 106 defined by catch 124. Pin portion 122 moves in the direction indicated by arrow 146 because ramp portion 126 slides in slot 128 (FIG. 9) at an oblique angle with respect to longitudinal axis 105. The above-described latch mechanism thus provides a means for latching by translating a force generated in a direction having a component parallel to longitudinal axis 105 into a force in a direction having a component perpendicular to longitudinal axis 105. This perpendicular force component lifts pin portion 122 out of the opening of catch 124, while a rearward force component also moves pin portion 122 slightly rearward of the opening of catch 124, as best seen in FIG. 8. When bail 114 has fully pivoted to the unlatched position, data communication module 102 can be withdrawn from EMI cage 104 in the manner described above.

One or more illustrative embodiments of the invention have been described above. However, it is to be understood that the invention is defined by the appended claims and is not limited to the specific embodiments described.

What is claimed is:

1. A data communication module, comprising:

module electronics for processing data communication signals;

a module housing, the module housing having an elongated rectangular shape elongated in a direction of a longitudinal axis between a first end and a second end, the first end of the module housing having a module port for receiving a signal cable plug connector, the second end of the module housing having electrical contacts, the module electronics providing a processing path for the data communication signals between the port and the electrical contacts, the module housing having a slot extending at an oblique angle to the longitudinal axis;

a bail mounted to the first end of the module housing through a bail pivot, the bail pivotable between a first position and a second position; and an actuator having a first end, a second end, and a portion slideably engaged with the slot, the first end of the actuator coupled through a cam pivot, the second end of the actuator having a pin portion disposed in an opening in a wall of the module housing, the actuator extending the pin portion through the opening in the wall in response to the bail pivoting to the first position, the actuator retracting the pin portion into the opening in the wall in response to the bail pivoting to the second position.

2. The data communication module of claim 1, wherein the cam pivot comprises a pair of pins on opposing sides of the actuator extending through a corresponding pair of elongated cam holes in the bail.

3. The data communication module of claim 1, wherein the pin portion of the actuator extends through an opening in a bottom wall of the module housing.

4. The data communication module of claim 1, wherein the actuator comprises a first actuator portion extending to the first end of the actuator, a second actuator portion extending to the second end of the actuator, and a ramp actuator portion between the first and second actuator portions, the first and second actuator portions are elongated in a direction parallel to the longitudinal axis of the module housing, and the ramp actuator portion is oriented at the oblique angle of the slot and engages the slot.

5. The data communication module of claim 4, wherein the pin portion extends from the first actuator portion a direction perpendicular to the longitudinal axis of the module housing.

6. The data communication module of claim 4, wherein the bail pivot comprises a pair of pins on opposing sides of the first end of the module housing that extend through a corresponding pair of bail pivot holes in the bail.

7. The data communication module of claim 6, wherein the bail comprises a first arm, a second arm parallel to the first arm, and a base portion connecting the first and second arms and perpendicular to the first and second arms, the first and second arms disposed on opposing sides of the module port, the base portion has the pair of elongated cam holes, and the first and second arms have the pair of bail pivot holes.

8. The data communication module of claim 7, wherein the pair of elongated cam holes are disposed eccentrically with respect to the pair of pivot holes.

9. A data communication module, comprising:

means for processing data communication signals;

a module housing, the module housing having an elongated rectangular shape elongated in a direction of a longitudinal axis between a first end and a second end, the first end of the module housing having a module port for receiving a signal cable plug connector, the second end of the module housing having electrical contacts;

means for latching the data communication module by translating a force generated in a direction parallel to the longitudinal axis of the module housing by a pivoting motion of a bail into a force in a direction perpendicular to the longitudinal axis of the module housing.

10. The data communication module of claim 1, further comprising an electromagnetic interference (EMI) cage.

11. The data communication module of claim 10, wherein the EMI cage is made of sheet metal.

12. The data communication module of claim 10, wherein the module housing is slideably receivable into an interior of the EMI cage.

13. The data communication module of claim 12, wherein:

the pin portion is configured to extend into a catch opening in the EMI cage when the pin portion is extended through the opening in the wall of the module housing; and the pin portion is configured to not extend into the catch opening in the EMI cage when the pin portion is retracted into the opening in the wall of the module housing.

14. The data communication module of claim 13, wherein:

the catch opening is disposed in a catch portion of the EMI cage; and the catch portion is configured to snap over the pin portion and capture the pin portion when the module housing is slid into the interior of the EMI cage.

15. The data communication module of claim 12, wherein the EMI cage includes an EMI skirt having resilient fingers distributed about an opening that receives the module housing.

16. The data communication module of claim 7, wherein each of the first and second arms of the bail has a hole engageable with a corresponding bump on the module housing.

17. The data communication module of claim 7, wherein each of the first and second arms have distal ends bent inwardly toward each other.

18. The data communication module of claim 1, wherein the module electronics includes a printed circuit board.

19. The data communication module of claim 18, wherein the electrical contacts comprise electrical contact pads on the printed circuit board.

20. The data communication module of claim 19, wherein the module port includes electrical contact fingers.

* * * * *